US011199038B2

(12) United States Patent
Dreyer

(10) Patent No.: US 11,199,038 B2
(45) Date of Patent: Dec. 14, 2021

(54) DOOR OPERATOR

(71) Applicant: ASSA ABLOY ENTRANCE SYSTEMS AB, Landskrona (SE)

(72) Inventor: Roger Dreyer, Bjarred (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 175 days.

(21) Appl. No.: 16/489,071

(22) PCT Filed: Mar. 6, 2018

(86) PCT No.: PCT/EP2018/055390
§ 371 (c)(1),
(2) Date: Aug. 27, 2019

(87) PCT Pub. No.: WO2018/162435
PCT Pub. Date: Sep. 13, 2018

(65) Prior Publication Data

US 2020/0011112 A1 Jan. 9, 2020

(30) Foreign Application Priority Data

Mar. 7, 2017 (SE) ..... 1730059-1

(51) Int. Cl.
*E05F 11/00* (2006.01)
*E05F 15/60* (2015.01)
*E05F 15/70* (2015.01)

(52) U.S. Cl.
CPC ..... *E05F 15/60* (2015.01); *E05F 15/70* (2015.01); *E05Y 2400/458* (2013.01);
(Continued)

(58) Field of Classification Search
CPC ..... E05F 2015/483; E05F 5/06; E05F 5/00; E05F 15/43; E05F 15/40; E05F 15/60;
(Continued)

(56) References Cited

U.S. PATENT DOCUMENTS 7,941,972 B2 * 5/2011 Kamiya ..... E05F 15/632 49/360
7,977,903 B2 * 7/2011 Kamiya ..... E05F 15/44 318/469

(Continued)

FOREIGN PATENT DOCUMENTS

DE 4245038 11/2003

OTHER PUBLICATIONS

International Search Report and Written Opinion of the International Searching Authority mailed in PCT/EP2018/055390 dated May 28, 2018.

(Continued)

*Primary Examiner* — Chi Q Nguyen
(74) *Attorney, Agent, or Firm* — Wissing Miller LLP

(57) ABSTRACT

A door operator and a method for moving a door leaf between a closed and open position utilize a drive unit, a control unit, and a supervise unit. The drive unit is connected to and moves the door leaf between the open and closed position. The control unit is connected to and controls the movement of the drive unit. The supervise unit includes a status management unit and one or more sensors that provide sensor data associated with an operation of the door leaf. The status management unit receives the sensor data from the one or more sensors, determines a status pattern from a plurality of status patterns of the operation of the door leaf at least based on the sensor data, with a first status pattern being associated with a status event, and triggers the status event in response to the first status pattern.

42 Claims, 5 Drawing Sheets

(52) U.S. Cl.
CPC ..... *E05Y 2400/50* (2013.01); *E05Y 2400/81* (2013.01); *E05Y 2400/85* (2013.01)

(58) Field of Classification Search
CPC ..... E05F 15/70; E05F 15/73; E05F 15/632; E05F 2017/005; E05Y 2400/504; E05Y 2400/458; E05Y 2400/502; E05Y 2800/404; E05Y 2400/852; E05Y 2400/508; E05Y 2900/132; E05Y 2400/50; E05Y 2201/254; E05Y 2400/21; E05Y 2201/25; E05Y 2201/256; E05Y 2201/21; E05Y 2400/532; E05Y 2900/531
USPC ..... 49/31, 26, 28, 36; 250/221; 701/49, 701/301, 45, 36, 26; 340/901, 540; 318/480, 445
See application file for complete search history.

(56) References Cited

U.S. PATENT DOCUMENTS 8,280,593 B2 * 10/2012 Nakakura ..... E05F 15/43 701/49
2003/0105559 A1 * 6/2003 Avenel ..... G07C 9/00309 701/2
2003/0213177 A1 11/2003 Fitzgibbon
2006/0160484 A1 * 7/2006 Falk ..... E06B 3/90 454/195
2006/0176171 A1 8/2006 Fitzgibbon
2008/0224642 A1 9/2008 Rodriguez
2008/0244978 A1 * 10/2008 Soyugenc ..... E05F 15/608 49/42
2010/0076651 A1 * 3/2010 Nakakura ..... G01S 7/4811 701/49
2011/0016971 A1 1/2011 Yulowski
2012/0212353 A1 * 8/2012 Fung ..... B60W 30/08 340/905
2013/0276373 A1 10/2013 Haab
2014/0115965 A1 * 5/2014 Raynal ..... E05F 15/79 49/31
2015/0077219 A1 3/2015 Keller, Jr.
2016/0001781 A1 * 1/2016 Fung ..... B60K 28/02 701/36
2020/0013021 A1 * 1/2020 Dreyer ..... G06Q 10/20
2020/0149339 A1 * 5/2020 Uno ..... B61L 23/00
2020/0208459 A1 * 7/2020 Trobro ..... E05F 15/603

OTHER PUBLICATIONS

SE Search Report mailed in SE 1730059-1 dated Nov. 1, 2017.

* cited by examiner

DOOR OPERATOR

This application is a 371 of PCT/EP2018/055390 filed on Mar. 6, 2018, published on Sep. 13, 2018 under publication number WO 2018/162435, which claims priority benefits from Swedish Patent Application No. 1730059-1 filed on Mar. 7, 2017, the disclosure of which is incorporated herein by reference.

FIELD OF THE INVENTION

The present invention relates to a door operator and a method performed in the door operator for determining a status pattern of the operation of the door operator and/or a door leaf connected to the door operator and triggering a status event at least based on the determined status pattern.

BACKGROUND OF THE INVENTION

A door operator typically comprises a control unit and a drive unit. The control unit controls the drive unit to move a door leaf between a closed and an open position. The control unit controls the trajectory of the door including the speed of the door, the opening angle of the door and time that the door should stay opened.

A door operator obtains input of that the door should be opened from activation sensors in the door operator that identify that a person or a vehicle is approaching the door. The service of the door operator is traditionally based on a prescheduled scheme based on time and/or number of opening cycles of the door leaf. The service scheme based on this will, however, lead to that the door operator in some cases will have service to often and that parts will be replaced based on time/cycles instead of their functionality. The service provider don't have any input of which parts in the door operator that has been exposed to an extensive wear and need to be replaced even if it is not included in the service scheme and this will lead to that the service provider will have to return for a second service after obtaining the needed service parts. Further, service of the door operator is called upon once the door operator stops functioning, i.e. a breakdown has already occurred, and this will lead to downtime of the door until it has been repaired.

SUMMARY OF THE INVENTION

An object of the present disclosure is to provide a door operator and a method which seek to mitigate, alleviate, or eliminate one or more of the above-identified deficiencies in the art and disadvantages singly or in any combination.

An object of the present disclosure is to provide a door operator and a method that reduces the downtime of the door operator.

An object of the present disclosure is to proved a door operator that can identify the status of its operation and/or the operation of the door leaf that it is connected to and to call for service based on the actual status of the door operator and/or door leaf.

An object of the present disclosure is to provide a door operator and a method that reduces the costs for service of the door operator.

In this disclosure, a solution to the problem outlined above is proposed. In the proposed solution, a door operator for moving at least one door leaf between a closed and an open position, comprising a drive unit, a control unit and an supervise unit, wherein the drive unit is adapted to be connected to and to move the at least one door leaf between the open and closed position, the control unit is connected to the drive unit and arranged to control the movement of the drive unit, the supervise unit comprise one or more sensors configured to provide sensor data associated with the operation of the door operator and/or the at least one door leaf; a status management unit configured to: receive the sensor data from the one or more sensors; determine a status pattern of the operation of the door operator and/or the door leaf out of a plurality of status patterns of the operation of the door operator and/or the door leaf at least based on the received sensor data, wherein at least a first status pattern out of the plurality of status patterns is associated with a status event, and trigger the status event in response to determination of at least the first status pattern.

By using the door operator according to the above a door operator is achieved that lowers the downtime of the door operator and the service costs. By determining a status pattern that is known, the status of the door operator is determined and this information could be used to lower the down time of the door operator.

According to a first aspect of the present invention, these objects are achieved by the door operator, wherein the status event associated with the first status pattern is a service alarm event.

According to an aspect, at least a second status pattern out of the plurality of status patterns is associated with a status event and wherein said status event is a non-service event of the door operator and the status management unit is configured to trigger the non-service event in response to determination of at least the second status pattern.

According to an aspect, at least a third status pattern out of the plurality of status patterns is associated with a status event and wherein said status event is an breakdown alarm event of the door operator and the status management unit is configured to trigger the breakdown alarm event in response to determination of at least the third status pattern.

According to an aspect, each status pattern is associated with a status event.

According to an aspect, the status management unit is configured to trigger the status event in response to determination of the corresponding status pattern.

According to an aspect, at least a fourth status pattern out of the plurality of status patterns is associated with a status event and wherein said status event is an Undefinable alarm event of the door operator and the status management unit is configured to trigger the Undefinable alarm event in response to determination of at least the fourth status pattern.

According to an aspect, the plurality of status patterns comprises a plurality of pre-defined status patterns.

According to an aspect, a user interface unit is connected to the supervise unit and configured to display an alarm based on the service alarm event, breakdown alarm event, and/or status event.

According to an aspect, the status management unit is further configured to trigger the service alarm event, breakdown alarm event, status event and/or no service event based on at least the determined status pattern.

According to an aspect, the status management unit comprises a data storage configured to store status data associated with the plurality of status patterns; and wherein to determine the status pattern further comprises to compare at least the received sensor data with the sensor data stored in the data storage.

According to an aspect, the data storage is configured to store the plurality of status patterns and status events.

According to an aspect, the door operator further comprise a radio communication interface connected to the supervise unit and configured to communicate with at least one remote entity.

According to an aspect, the status management unit is further configured to determine the status pattern of the operation of the door operator and the door leaf out of a plurality of status patterns at least based on a data received by the radio communication interface.

According to an aspect, the radio communication interface is configured to receive the service alarm event from the status management unit and to send a service alarm to the at least one remote entity.

According to an aspect, the status management unit further is arranged to transmit from the sensors received sensor data to the at least one remote entity via the radio communication interface and receive from the at least one remote entity at least one of: a status pattern out of the plurality of status patterns; determine the service alarm event, breakdown alarm event, status event and/or non-service event.

According to an aspect, the door operator further comprise: a data storage configured to store sensor data; wherein the status management unit is configured to in response to determination of the status pattern: save the sensor data associated with the operation of the door operator and/or the at least one door leaf in the data storage and wherein the status management unit is further configured to transmit the saved sensor data to the at least one remote entity via the radio communication interface.

According to an aspect, the status management unit is further configured to: receive via the radio communication interface from the at least one remote entity at least one status pattern; store the received at least one status pattern in the data storage.

According to an aspect, at least a fourth status pattern out of the plurality of status patterns is associated with an undetermined status pattern of the operation of the door operator and/or the at least one door leaf, and the status management unit is configured to in response to determination of the fourth status pattern: send at least the received sensor data via the radio communication interface to at least the remote entity and receive via the radio communication interface from the at least one remote entity a decision whether the status pattern of the operation of the door operator and the at least one door leaf is of at least the first status pattern or the second status pattern.

According to an aspect, the one or more sensor is a sound sensor, a movement sensor, voltage sensor, current sensor, resistance sensor, temperature sensor, a light sensor, a pressure sensor, a humidity sensor, a time sensor, a global positioning system (GPS), infrared sensor, a camera, a ccd-camera, a time of flight sensor and/or ultrasonic sensor.

According to an aspect, the status management unit is configured to receive data associated with the control unit and the presence sensors, wherein determine the status pattern of the operation of the door operator and/or the door leaf further based on the received data.

According to an aspect, the one or more sensor is configured to provide sensor data from one or more of a battery, the drive unit, a belt transmission, a carriage wheel, an arm system and a floor guide, sealing's, springs, gear box, guide rails, brakes, shaft, bearings, activation sensors, safety sensors, combined sensors, sensors, light grids, mechanical sensors of the door operator and/or the said at least one door leaf.

According to an aspect, the supervise unit is configured to via the radio communication interface and/or user interface receive data comprising a confirmation of if the determined status pattern was correct or not.

According to an aspect, the plurality of status patterns of the operation of the door operator and/or the door leaf is configured to be updated based on said received data.

According to an aspect, the control unit comprise the supervise unit.

According to an aspect, the control unit and the supervise unit is integrated.

According to an aspect, the door operator is a revolving door operator, a swing door operator, a hinged door operator, an up and over door operator, a roll door operator, a garage door operator, an industrial door operator, a high speed door operator, a sectional door operator, a gate operator, a barrier operator, an or any device having the same function as a door operator.

In this disclosure, a further solution to the problem outlined above is proposed. In the proposed solution, a method in a door operator for moving at least one door leaf between a closed and an open position is disclosed. The door operator comprise a drive unit, a control unit and an supervise unit, and the method comprising obtaining sensor data associated with the operation of the door operator and/or the at least one door leaf, from one or more sensors of the supervise unit; receiving the sensor data from the one or more sensors in a status management unit of the supervise unit; determining a status pattern of the operation of the door operator and/or the door leaf out of a plurality of status patterns of the operation of the door operator and/or the door leaf at least based on the received sensor data, wherein at least a first status pattern out of the plurality of status patterns is associated with a status event and triggering the status event in response to determining of at least the first status pattern.

By using the method according to the above a door operator is achieved that lowers the downtime of the door operator and the service costs. By determining a status pattern that is known the status of the door operator is determined and this information could be used to lower the down time of the door operator.

According to an aspect, the status event is a service alarm event.

According to an aspect, at least a second status pattern out of the plurality of status patterns is associated with a status event and wherein said status event is a non-service event of the door operator and further comprising the step of triggering the non-service event in response to determination of at least the second status pattern.

According to an aspect, at least a third status pattern out of the plurality of status patterns is associated with a status event and wherein said status event is an breakdown alarm event of the door operator and further comprising the step of triggering the breakdown alarm event in response to determination of at least the third status pattern.

According to an aspect, each status pattern is associated with a status event.

According to an aspect, the method further comprising the step of triggering the status event in response to determination of a status pattern associated with said status event.

According to an aspect, the method further comprising the step of displaying an alarm based on triggering of the service alarm, breakdown alarm event and/or status event.

According to an aspect, the method further comprising the step of determining the service alarm event, breakdown alarm event, status event and/or non-service event based on at least the determined status pattern.

According to an aspect, the step of determining the status pattern further comprising the step of comparing at least the received sensor data with the sensor data stored in a data storage of the door operator.

According to an aspect, the step of determining the status pattern further comprising the step of comparing the sensor data with sensor data received by a radio communication interface.

According to an aspect, the method further comprising the step of transmitting from the one or more sensors received sensor data to at least a remote entity via the radio communication interface, and receiving from the at least a remote entity at least one of: a status pattern out of the plurality of status patterns; the service alarm event, the breakdown alarm event, the status event and/or the non-service event.

According to an aspect, the method further comprising the step of receiving, via the radio communication interface from the at least a remote entity, at least one status pattern and storing the received at least one status pattern in the data storage.

According to an aspect, the method further comprises the step of receiving data from the control unit and/or presence sensors of the door operator, and wherein the step of determining the status pattern of the operation of the door operator and/or the door leaf further is based on said received data.

According to an aspect, the method further comprising the step of receiving, via the radio communication interface and/or user interface, data comprising a confirmation of if the determined status pattern was correct or not.

According to an aspect, the method further comprising the step of updating the plurality of status patterns of the operation of the door operator and the door leaf based on said received data.

Generally, all terms used in the claims are to be interpreted according to their ordinary meaning in the technical field, unless explicitly defined otherwise herein. All references to "a/an/the [element, device, component, means, etc.]" are to be interpreted openly as referring to at least one instance of said element, device, component, means, etc., unless explicitly stated otherwise. Further, by the term "comprising" it is meant "comprising but not limited to" throughout the application.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

Aspects of the present disclosure will be described more fully hereinafter with reference to the accompanying figures. The assembly disclosed herein can, however, be realized in many different forms and should not be construed as being limited to the aspects set forth herein.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The present invention relates to door operators for different types of doors, door sets and door leafs. More specifically, the invention relates to door operators for any type of door, a sectional door, a high speed door, a gate or barrier obstructing passage, such as a revolving door, a swing door, a hinged door, an up and over door, a roll door, a garage door, an industrial door, a gate, a barrier, an or any device having the same function as a door.

According to an aspect, a door system comprises one or more door operators connected to one or more door leafs.

Figure 3:
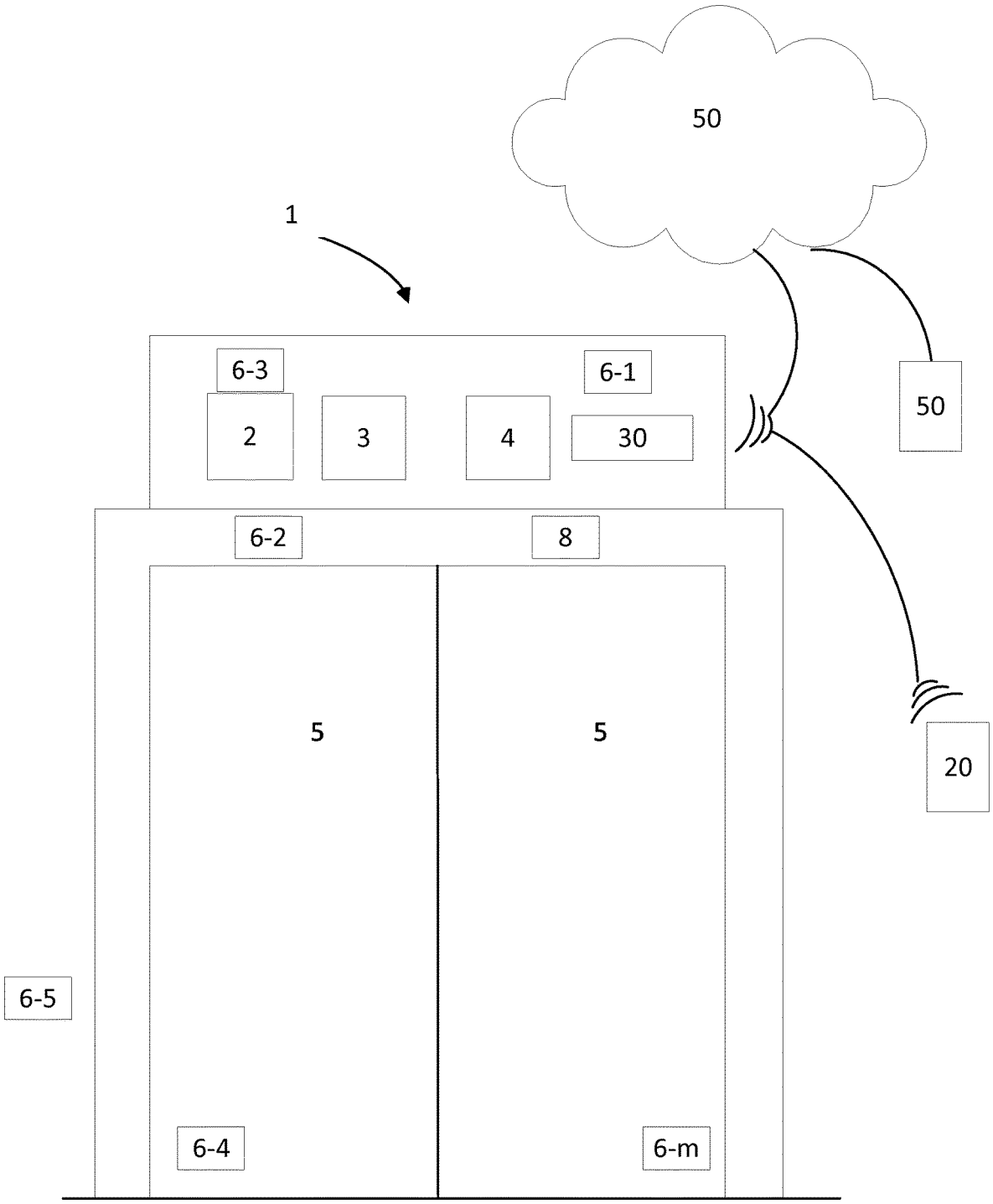
FIG. 3 shows a schematic view of a sliding door and a door operator in accordance with an aspect of the invention.
Figure 4:
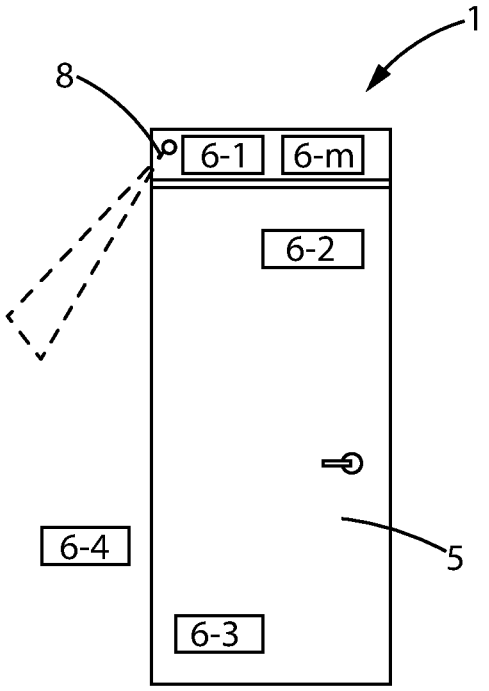
FIG. 4 shows a schematic view of a swing door and a door operator in accordance with an aspect of the invention.
Figure 5:
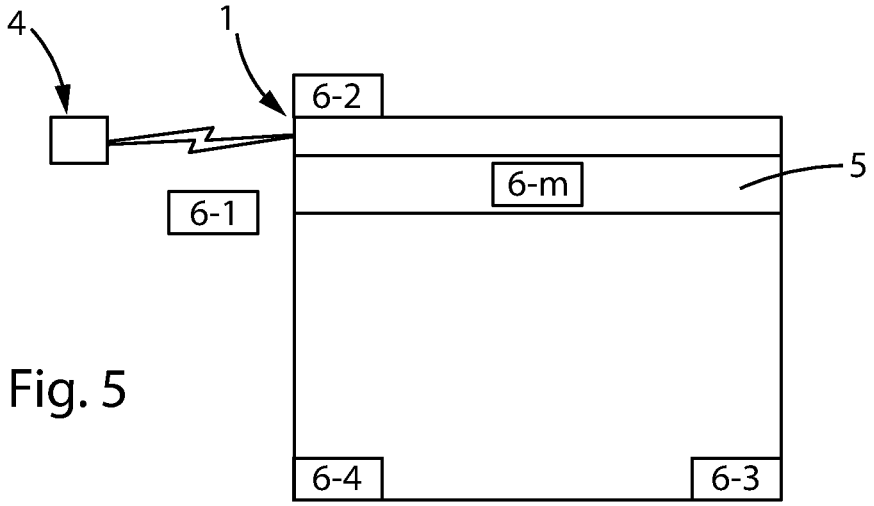
FIG. 5 shows a schematic view of a roll door and a door operator in accordance with an aspect of the invention.

The door operator 1 disclosed in FIG. 3 is a sliding door operator 1 connected to two door leafs 5. The door operator 1 disclosed in FIG. 4 is a swing door operator 1 connected to a door leaf 5. The door operator 1 disclosed in FIG. 4 is a high speed door operator 1 connected to a door leaf 5.

In FIGS. 1 to 5 discloses the door operator 1 comprising a drive unit 2, a control unit 3 and a supervise unit 4. The door operator further comprises one or more of a battery (not disclosed), a belt transmission (not disclosed), a carriage wheel (not disclosed), an arm systems (not disclosed) and presence sensors (not disclosed). These components as such are known in the art and will not be described in detail herein. The door operator can also comprise further components.

The drive unit 2 is connected to the control unit 3. The drive unit 2 comprise a motor and a gearbox. The drive unit 2 is adapted to be connected to a door/door leaf/door set 5 and to move the door leaf 5 between an open and closed position, i.e. from an open position to a closed position and from a closed position to an open position. The drive unit 2 as such, its connection to the door leaf 2 and its connection to and interaction with the control unit 3 is known in the art and will thus not be described in more detail herein.

The control unit 3 is connected to the drive unit 2. The control unit 3 is connected to the supervising unit 4. The connection between the control unit 3, drive unit 2 and the supervise unit 4 is an electronically connection as disclosed in FIG. 1. According to some aspects the control unit 3 is connected to the supervise unit 4, as disclosed in FIG. 2, and the drive unit 2 via a wireless connection suitable for sending electronic signals. The connection may also be a combination of wired and wireless connection. Examples of wireless connections are Bluetooth™, WiFi, Infrared or any kind of near field communication technology. According to some aspects the control unit 3 is directly connected to the supervise unit 4 and the drive unit 2. Directly connected means that the control unit 3 is in direct communication with the supervise unit 4 and the drive unit 2. Direct communication may occur both via a wired connection or a wireless connection or a combination of both. In the case of wireless connection there will be a transceiver for the wireless signal on both the control unit 3 side, the drive unit 2 side and supervise unit 4 side. Data can be sent to and from the supervise unit 4, to the control unit 3 and to the drive unit 2. The control unit 3 comprise a central processor unit (CPU) not shown and a memory (not disclosed). The control unit 3 controls the movement of the drive unit 2. According to an aspect the supervise unit 4 is comprised in the control unit 2. According to an aspect the control unit 3 and the supervise unit 4 is an integrated unit.

The control unit 3 controls when the drive unit 2 should move the door leaf 5 between the open and closed position and how it should move it. The trajectory that the control unit 3 controls the drive unit 2 to move the door leaf 5 along comprise information of which speed the door leaf 5 should be moved, acceleration, braking, the opening time, for how long the door should be open and/or the closing speed etc. The control unit 3 can store different trajectories, at least a first and a second trajectory, and control the drive unit 2 to move the door leaf 5 along different trajectories. The control unit 3 is connected to one or more presence sensors 8 and/or activation sensors 8 arranged to detect objects and persons approaching the door operator 1 and to send data to the control unit 3 if a person is detected.

The control unit 3 as such is known in the art and is not described in more detail herein.

The door operator 1 further comprise one or more of a battery, a belt (not disclosed), transmissions (not disclosed), an arm system (not disclosed), one or more carriage wheels (not disclosed) and one or more sensors 8.

According to one aspect, the door leaf 5 is connected to one or more of the arm systems, floor guides and carriage wheels.

The door operator 1 as such can comprise further features and component that is known in the art, and will thus not be further described herein.

The door leaf 5 as such can comprise further features and component that is known in the art, and will thus not be further described herein.

The supervise unit 4 comprise one or more sensors 6-1, 6-2, . . . , **6-*m* and a status management unit 12. The supervise unit 4 comprise a central processor unit (CPU) 9 and a memory 10. According to an aspect, the supervise unit 4 comprise a storage unit 11**.

The sensors 6-1, 6-2, . . . , **6-*m* are adapter to observe and provide sensor data of the operation of the door operator 1 and/or the operation of the door leaf 4. Put in another way, the sensors 6-1, 6-2, . . . , 6-*m* are arranged to create sensor data corresponding to the functionality of the operation of the door. By providing sensor data is meant that the sensor 6-1, 6-2, . . . , 6-*m* provide/create/measure/obtains/observe it's surrounding and components and create data of it that could be transferred. According to an aspect, the one or more sensors 6-1, 6-2, . . . , 6-*m* are configured to provide sensor data associated with the operation of the door operator 1 and/or the at least one door leaf 5**.

Sensor data is a digital version of the things that the sensors 6-1, 6-2, . . . , **6-*m* has observed and could be data comprising information of sound waves, temperature, vibration, number of cycles, current, voltage, inertia, light, light waves, pictures, acceleration, friction and many other things, encoder etc. of the components and areas that the sensor 6-1, 6-2, . . . , 6-*m*** are sensing.

According to an aspect the one or more sensors 6-1, 6-2, . . . , **6-*m*** is one of a sound sensor, a movement sensor, voltage sensor, current sensor, resistance sensor, temperature sensor, a light sensor, a pressure sensor, a humidity sensor, a time sensor, a global positioning system (GPS), infrared sensor, a camera, a ccd-camera, a time of flight sensor and/or ultrasonic sensor.

Figure 1:
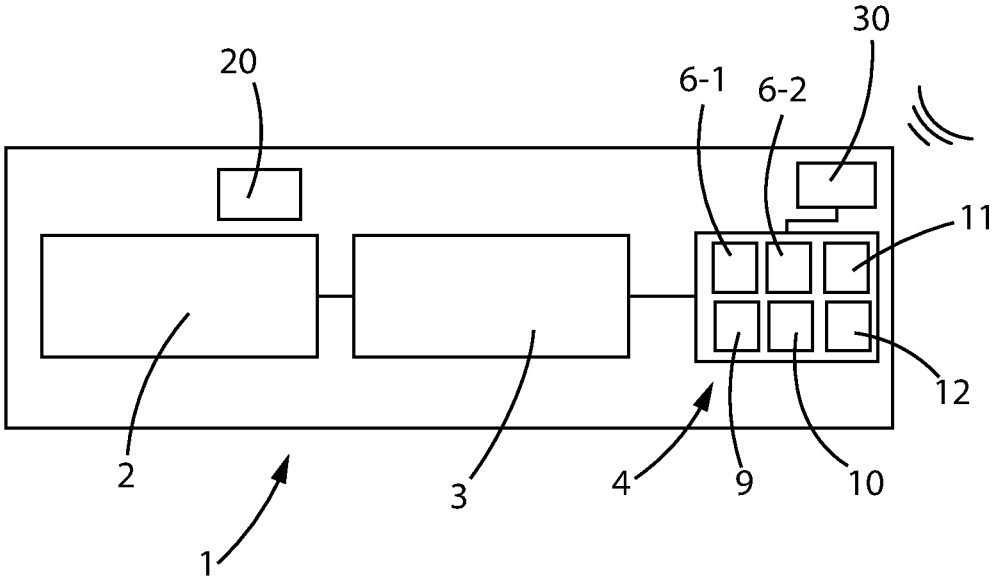
FIG. 1 discloses a schematic view of a door operator according to an aspect of the invention.
Figure 2:
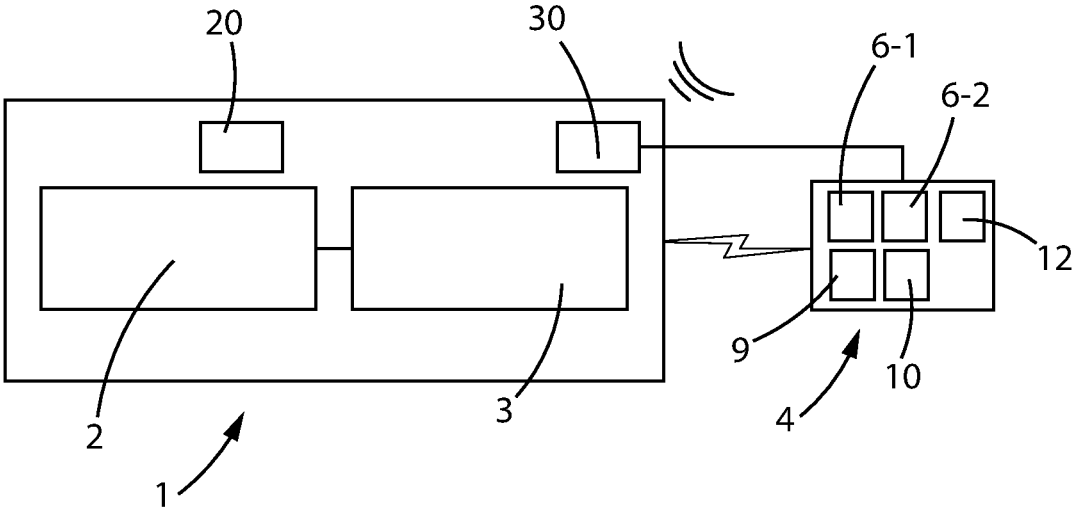
FIG. 2 disclose a schematic view of a door operator according to an aspect of the invention.

According to an aspect the one or more sensors 6-1, 6-2, . . . , **6-*m* is positioned at components 2, 3, 4, 7 of the door operator 1, on the door leaf 5 and/or at the vicinity of the door operator 1 and the door leaf 5. In FIGS. 1 and 2, which is now referred to, the supervise unit 4 comprise a number of sensors 6-1, 6-2, . . . , 6-*m***.

The sensors 6-1, 6-2, . . . , **6-*m* are connected to the status management unit 12. According to an aspect, the one or more sensors 6-1, 6-2, . . . , 6-*m* are arranged to send sensor data to the status management unit 12. The sensors 6-1, 6-2, . . . , 6-*m* are electronically connected to the status management unit 12. According to some aspects the sensors 6-1, 6-2, . . . , 6-*m* is connected to the status management unit 12, via a wireless connection suitable for sending electronic signals. The connection may also be a combination of wired and wireless connection. Examples of wireless connections are Bluetooth™, WiFi, Infrared or any kind of near field communication technology. According to some aspects the sensors 6-1, 6-2, . . . , 6-*m* is directly connected to the status management unit 12 of the supervise unit 4. Directly connected means that the sensors 6-1, 6-2, . . . , 6-*m* are in direct communication with the status management unit 12. Direct communication may occur both via a wired connection or a wireless connection or a combination of both. In the case of wireless connection there will be a transceiver for the wireless signal on both the sensor 6-1, 6-2, . . . , 6-*m* sides and the status management unit 12** side.

According to an aspect, data is sent to and from the status management unit 12 to the sensors 6-1, 6-2, . . . , **6-*m***.

The status management unit 12 does according to an aspect comprise a central processor unit (CPU) (not disclosed) and a memory (not disclosed).

According to an aspect, the door operator 1 comprises a user interface unit 20. The user interface unit 20 is connected to the supervise unit 4. The user interface unit 20 is configured to display an alarm based on the service alarm event, breakdown alarm event, and/or status event. According to an aspect, the user interface unit 20 is a display and/or one or more lamps. According to one aspect, the user interface unit 20 comprise 3 lamps, a green lamp corresponding to the non-service event, a yellow lamp indicating the service alarm event and a red lamp indicating a breakdown event.

According to an aspect, the door operator 1 further comprise a radio communication interface 30 connected to the supervise unit 4 and configured to communicate with at least one remote entity 50. The radio communication interface 30 may be comprised as any number of tranceiving, receiving, and/or transmitting units or circuitry. It should further be appreciated that the radio communication interface 30 may be in the form of any input/output communications port known in the art. The radio communication interface 30 may comprise RF circuitry and baseband processing circuitry. The radio communication interface 30 may support either wireless and/or wired communication. Examples of wireless communication may be Global System for Mobile Communication, GSM, Bluetooth, narrowband communication, Internet of Things, loT, specific communication.

According to an aspect, the one or more remote entity 50 is a server, a database, a further door operator and/or the cloud.

The status management unit 12 is configured to receive the sensor data from the one or more sensors 6-1, 6-2, . . . , **6-*m*. The status management unit 12 is configured to determine a status pattern of the operation of the door operator 1 and/or the door leaf 5 out of a plurality of status patterns of the operation of the door operator 1 and/or the door leaf 5** at least based on the received sensor data.

According to an aspect, the status pattern is a pattern found in the sensor data or associated with the sensor data. The status pattern could be a pattern of sounds in a certain order and at a certain frequencies. The status pattern could be a pattern from sensor data from one or more sensors. The status pattern could be a pattern from sensor data from different one or more sensors 6-1, 6-2, . . . , **6-*m*. The status pattern is a pattern that corresponds to one of a plurality of status patterns of the operation of the door operator 1 and/or the door leaf 5 at least based on the received sensor data. By determining a status pattern out of a plurality of status pattern a status of the door operator 1 and/or the door leaf 5 could be determined. According to some aspects, the determined status pattern is an indication of that something is wrong in the door operator 1 and/or the door leaf 5. Put in another way, by identifying and determining the status pattern out of the sensor data out of a plurality of status patterns the status of the door operator 1 could be determined. According to some aspects, the determined status patterns is an indication of that all is OK in the door operator 1 and/or the door leaf 5. According to some aspects, the determined status patterns is an indication of that something has broken in the door operator 1 and/or the door leaf 5**.

According to one aspect, the plurality of status patterns are stored in the supervise unit 4. The received sensor data is compared to the status pattern to determine if the received sensor data corresponds to any of the plurality of status patterns. If a status pattern is determined out of the plurality of status patterns as a known status of the door operator 1 and/or the door leaf 5 is identified. If the status management unit 12 identifies a status pattern in the received sensor data it will determine that the status pattern is associated with said sensor data.

A status event is a description of a number actions that will happen if something else happens. According to an aspect, a status event is connected to a status pattern. Put in another way, if a status pattern is identified and determined by the status management unit 12 and a status event is connected to said status pattern, the events connected to the status event will be performed if/when the status event is triggered.

According to an aspect, a status event could be a service alarm event. The service alarm event is at least associated with determination of a first status pattern out of the plurality of status patterns. A service alarm event could comprise events such that informing the service provider of the door operator 1 that the door operator needs service. This could be done by indicating that a service is needed on the user interface unit 20. This will inform a person responsible for the door operator 1 that a service is needed to avoid a breakdown of the door operator 1 and/or the door leaf 5. A service alarm event could comprise information of the importance of the service need, for instance it needs to have service within 1, 2 or 4 weeks.

According to an aspect, several different status patterns could be associated with a service alarm event identifying a need of service.

According to an aspect, the status event could comprise an action of sending information of the need for service directly to the service provider via the radio communication interface 30.

According to an aspect, the status event could comprise information of which part of the door operator 1 and/or the door leaf 5 that has a need for service, either via the user interface unit 20 or directly to the service provider via the radio communication interface 30.

By identifying and indicating that the door operator 1 and/or door leaf 5 is in need of service reduces the downtime of a door operator 1 since it can receive service before a part breaks. Further, it also can reduce the cost of service since parts don't need to be replaced in advance and the service provider knows which parts that needs service before he arrives at the door operator 1 and can plan the service better and have the correct components with him.

According to an aspect, the status event is a non-service event. A non-service event indicates that the status of the door operator 1 and/or the door leaf 5 is OK and no service is needed. A non-service event could be identified or indicated via the user interface unit 20 or the radio communication interface 30. By receiving information of a non-service event one receives information of that the door operator 1 is working correct.

According to an aspect, the status event is a breakdown alarm event. A breakdown alarm event indicates that the status of the door operator 1 and/or the door leaf 5 is not OK and that it has stopped functioning. A breakdown alarm event could be identified or indicated via the user interface unit 20 or the radio communication interface 30. The breakdown alarm event is associated with a status pattern and the service provider could get information of the type of breakdown that has occurred and thus the breakdown could be solver quicker as the service provider could have the right equipment and spare parts with him the first time visiting the door operator 1.

The supervise unit 4 is arranged to receive sensor data from the sensors 6-1, 6-2, . . . , **6-*m***.

According to an aspect, the supervise unit 4 is arranged to receive feedback information after a service of the door operator 1 comprising information of if the determined status pattern was correct or not.

Figure 6:
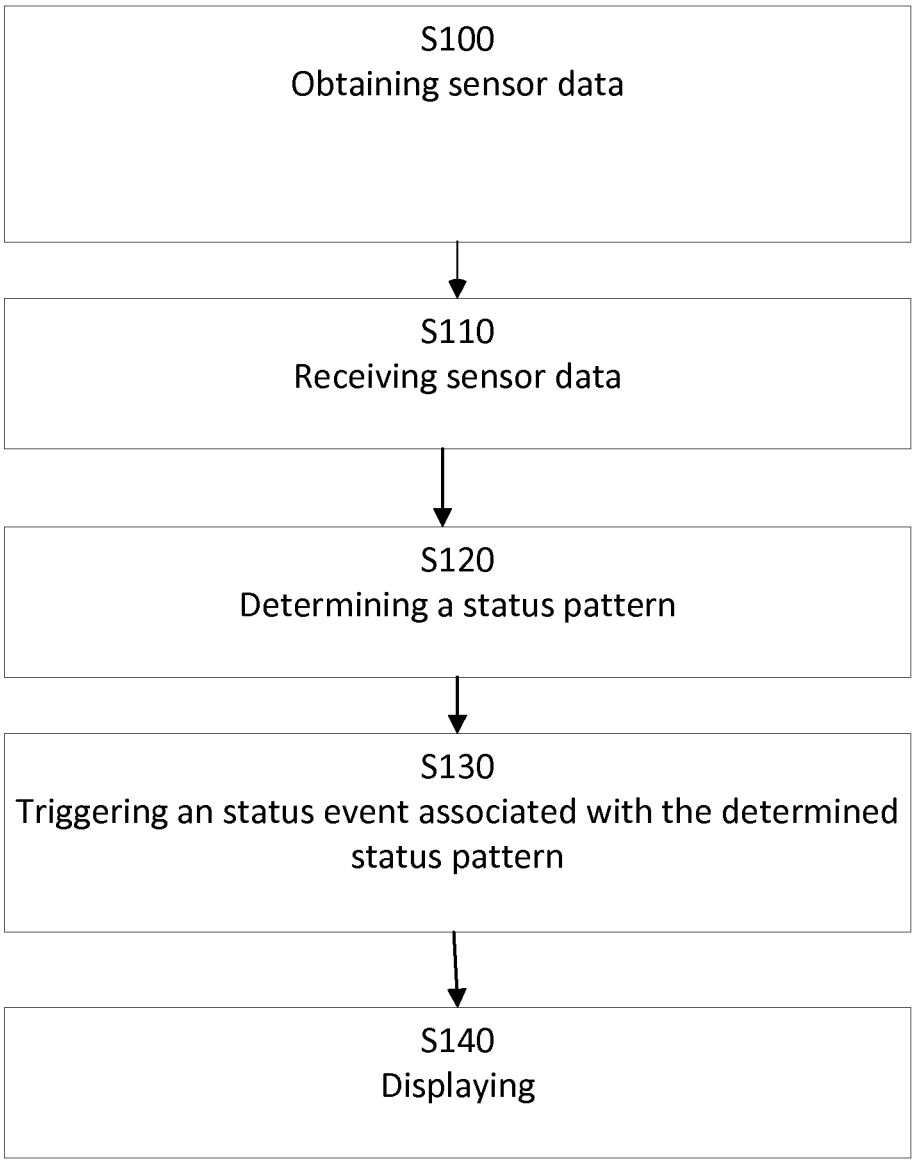
FIG. 6 shows a schematic view of a method performed in a door operator in accordance with an aspect of the invention.
Figure 7:
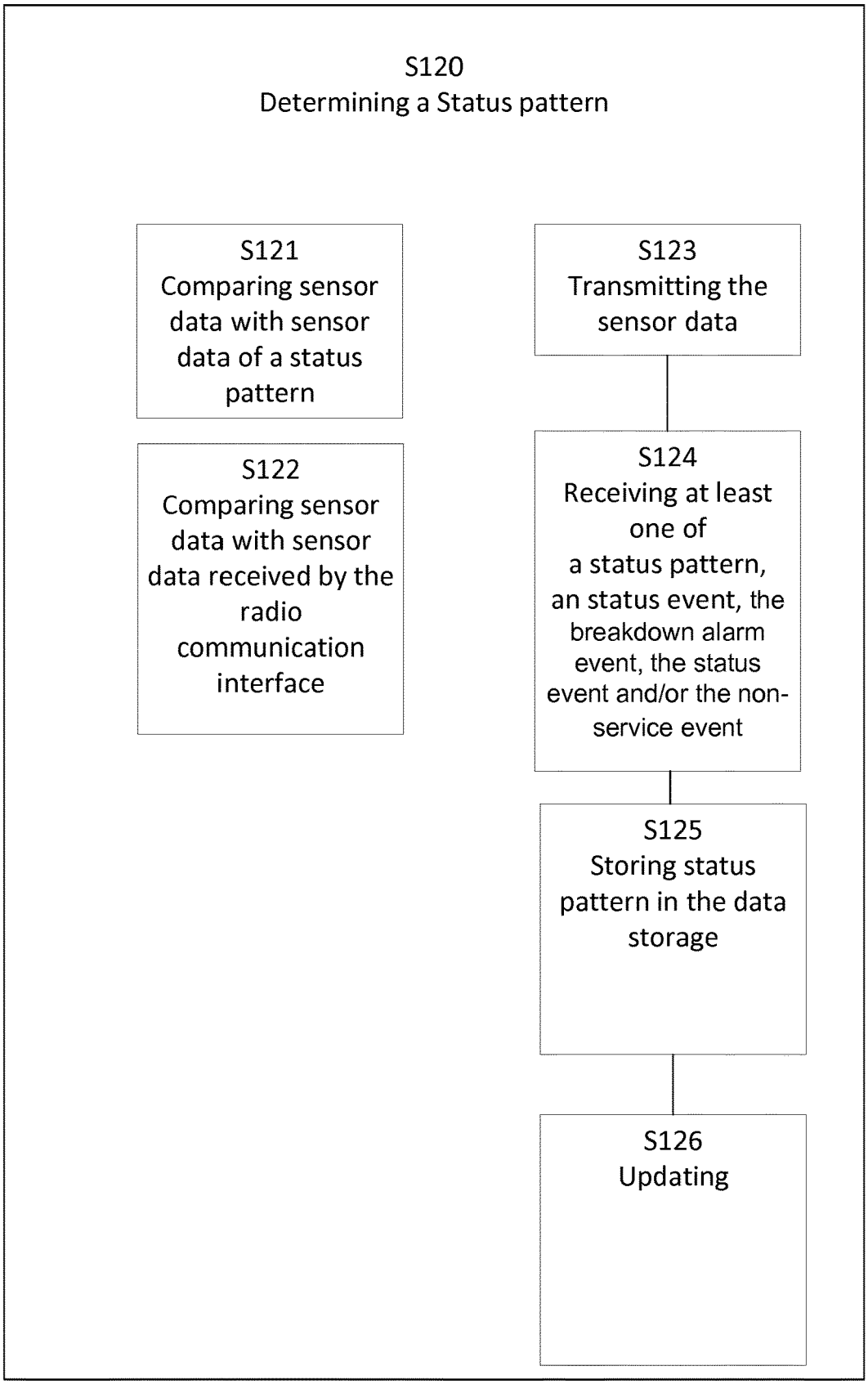
FIG. 7 shows a schematic view of a method performed in a supervise unit in accordance with an aspect of the invention.

Hereafter, the method of how the door operator 1 in FIG. 1-5. in accordance to aspects of the invention will be described with reference to FIG. 6 and FIG. 7.

The method comprising:

obtaining S100 sensor data associated with the operation of the door operator 1 and/or the at least one door leaf 5, from one or more sensors 6-1, 6-2, . . . , **6-*m* of the supervise unit 4**;

receiving S110 the sensor data from the one or more sensors 6-1, 6-2, . . . , **6-*m* in the status management unit 12 of the supervise unit 4**;

determining S120 a status pattern of the operation of the door operator 1 and/or the door leaf 5 out of a plurality of status patterns of the operation of the door operator 1 and/or the door leaf 5 at least based on the received sensor data, wherein at least a first status pattern out of the plurality of status patterns is associated with a status event and triggering 130 the status event in response to determining S120 of at least the first status pattern.

According to an aspect, said status event is a service alarm event.

The step of determining S120 could further comprise determining at least a second status pattern out of the plurality of status patterns. The second status pattern is associated with a status event that is a non-service event of the door operator 1. The step of triggering S130 comprise triggering S130 the non-service event in response to determination S120 of at least the second status pattern.

The step of determining S120 could further comprise determining at least a third status pattern out of the plurality of status patterns. The third status pattern is associated with a status event that is a breakdown alarm event of the door operator 1. The step of triggering S130 comprise triggering S130 the breakdown alarm event in response to determination S120 of at least the third status pattern.

According to an aspect, each status pattern is associated with a status event.

The step of triggering S130 comprise triggering S130 the status event in response to determination S120 of a status pattern associated with said status event.

A status event comprise different events that is performed when the status event is triggered S130. A status event according to an aspect comprise the step of displaying S140 an alarm based on triggering S130 of the service alarm, breakdown alarm event and/or status event.

According to an aspect, the step of triggering S130 the service alarm event, breakdown alarm event, status event and/or non-service event is based on at least the determined status pattern.

According to an aspect, the step of determining S120 the status pattern comprise the step of comparing S121 at least the received sensor data with the sensor data stored in a data storage of the door operator 1, supervise unit 4 and/or status management unit 12.

According to an aspect, the step of determining S120 the status pattern comprise the step of comparing S122 the sensor data with sensor data received by a radio communication interface 30.

According to an aspect, the method comprise the step of transmitting S123 from the one or more sensors 6-1, 6-2, . . . , **6-*m* received sensor data to at least a remote entity 50 via the radio communication interface (30), and receiving S124 from the at least a remote entity 50** at least one of: a status pattern out of the plurality of status patterns; the service alarm event, the breakdown alarm event, the status event and/or the non-service event.

After the step of receiving S124, the step of storing S125 the received at least one status pattern in the data storage 10, 11 is performed.

According to an aspect, the step of receiving S110 comprise the step of receiving data from the control unit 3 and/or presence sensors 8 of the door operator 1, and wherein the step of determining S120 the status pattern of the operation of the door operator 1 and/or the door leaf 5 further is based on said received data.

According to an aspect, the step of receiving S110 comprise the step of receiving, via the radio communication interface 30 and/or user interface 20, data comprising a confirmation of if the determined S120 status pattern was correct or not.

According to an aspect, the method comprise the step of updating S126 the plurality of status patterns of the operation of the door operator 1 and the door leaf 5 based on said received data.

According to one aspect, one or more of the one or more sensors 6-1, 6-2, . . . , **6-*m* is a resistance sensor. The resistance sensor 6-1, 6-2, . . . , 6-*m* is configured to observe and obtain status data associated with the inner resistance of the battery of the door operator 1. The sensor data associated with the inner resistance of the battery is measured and obtained by applying a short and high current peek (10C for 100***ms* as an example). The obtaining of the sensor data will not affect the capacity of the cell of the battery and therefore the sensors 6-1, 6-2, . . . , **6-*m* will obtain a sensor data corresponding to/associated with the inner resistance of the battery, Further, the sensor 6-1, 6-2, . . . , 6-*m* could also obtain sensor data associated with the fault of the cables and fuses (not disclosed), which all are important for the status of the battery. According to an aspect, these measurements are done locally in the door operator 1. According to an aspect, status management unit 12 configured to receive the sensor data from the resistance sensor 6-1, 6-2, . . . , 6-*m* and to determine a status pattern of the operation of the battery and/or the cables and fuses. The determined status pattern is based on the received sensor data and the status pattern will thus be different depending on the status of the battery. According to an aspect, the resistance sensor 6-1, 6-2, . . . , 6-*m* comprise a current sensor and a voltage sensor 6-1, 6-2, . . . , 6-*m***.

According to an aspect, one or more of the one or more sensors 6-1, 6-2, . . . , **6-*m* is a temperature sensor. According to an aspect, one or more of the one or more sensors 6-1, 6-2, . . . , 6-*m* is a charge level sensor. The temperature sensor 6-1, 6-2, . . . , 6-*m* is arranged to obtain sensor data that is associated with the temperature of the battery. The charge level sensor 6-1, 6-2, . . . , 6-*m*** is arranged to obtain sensor data that is associated with the charge level of the battery.

According to an aspect the status management unit 12 receives the sensor data obtained from one or more of the resistance sensor 6-1, 6-2, . . . , **6-*m*, the temperature sensor 6-1, 6-2, . . . , 6-*m* and charge level sensor 6-1, 6-2, . . . , 6-*m* and determine a status pattern that is associated with the status of the battery. Further, the status management unit 12 receives the sensor data obtained from one or more of the resistance sensor 6-1, 6-2, . . . , 6-*m*, the temperature sensor 6-1, 6-2, . . . , 6-*m* and charge level sensor 6-1, 6-2, . . . , 6-*m* and determine a status pattern associated with a prediction of how long time the battery will last in the environment of the door operator 1. The status management unit 12 trigger a status event in response to determination of at least the first status pattern. According to an aspect, the status management unit 12 is arranged to trigger a service alarm event that is associated with the status pattern. The status event could be associated with a status pattern of different predetermined statuses of the battery. According to an aspect, the service alarm event could be triggered by the status management unit 12 in response to a determined status pattern associated with that the battery has 1 week, 2 weeks or a month until a predicted breakdown of the battery will occur. According to an aspect, the sensor data from the resistance sensor 6-1, 6-2, . . . , 6-*m* comprising data of the inner resistance is sent together with the temperature of the battery and the charge level could be sent to the remote entity 50. According to an aspect, the sensor data comprising data of the inner resistance is sent to the remote entity 50**.

According to an aspect, one or more of the one or more sensors 6-1, 6-2, . . . , **6-*m* is a battery capacity sensor. The battery capacity sensor 6-1, 6-2, . . . , 6-*m* is arranged to provide sensor data associated with the capacity of the battery. According to an aspect, sensor data associated with the battery capacity is obtained by a high current for a longer time and to quantify the angle of the discharge curve. According to an aspect this is done locally on the door operator. According to an aspect, the sensor data associated with the temperature and charge level of the battery is received by the status management unit 12 and considered together with the sensor data associated with the battery capacity to determine a status pattern out of a plurality of status patterns that is associated with different statuses of the door operator and predictions of the remaining life time of the battery. According to an aspect, the status management unit 12 trigger a service alarm event in response to that a status pattern associated with that the battery has 1 week, 2 weeks or a month until a predicted breakdown of the battery will occur is determined. According to an aspect, sensor data comprising data of the inner resistance is sent together with the temperature of the battery and the charge level to the remote entity 50. According to an aspect, sensor data comprising data of the inner resistance is sent to the remote entity 50**.

According to an aspect, one or more of the one or more sensors 6-1, 6-2, . . . , **6-*m* is a voltage sensor. The voltage sensor is arranged to provide sensor data associated with that the battery comprise on or more dead battery cells (not disclosed). According to an aspect, dead battery cells can be identified by the voltage sensor 6-1, 6-2, . . . , 6-*m* obtaining sensor data associated with the voltage of a battery that have been disconnected from load and charging during 10 minutes. The cell voltage will harmonize around a predetermined voltage per cell and together with sensor data associated with the temperature of the battery sensor data associated with the number of active cells can be calculated. According to an aspect, status management unit 12 is configured to receive the sensor data from the voltage sensor 6-1, 6-2, . . . , 6-*m*** and to determine a status pattern of the operation of the battery and the number of dead battery cells. The determined status pattern is based on the received sensor data and the status pattern will thus be different depending on the number of dead cells in the battery.

According to an aspect the sensor data associated with the temperature and charge level could be considered by the status management unit 12 together with the sensor data associated with the number of active cells to determine a status pattern that is associated with the remaining life time of the battery. According to an aspect, the status management unit 12 triggers a status event associated with the determined status pattern. The status event could be a status alarm event. The status alarm event could trigger a service alarm in response to that a status pattern associated with that the battery has 1 week, 2 weeks or a month until a predicted breakdown of the battery will occur.

According to an aspect, sensor data comprising data of the voltage of the battery and the number of active cells is sent together with the temperature of the battery and the charge level to the remote entity 50. According to an aspect, the nominal voltage is sent, separate or together with the temperature and the charge level, for long time predictability of the remaining life time of the battery in different environments.

According to an aspect, a voltage sensor 6-1, 6-2, . . . , **6-*m* is arranged to provide sensor data associated with a broken fuse. According to an aspect, the broken fuse is identified by obtaining sensor data associated with the voltage of the battery during charging and load. If the sensor data comprise information of that the voltage is high during charging and 0 v during load, this is an indication of that a fuse is broken. According to an aspect, status management unit 12 receives the sensor data from the voltage sensor 6-1, 6-2, . . . , 6-*m* and determine a status pattern associated with a pattern in the sensor data that corresponds to one or more broken fuses. The determined status pattern is based on the received sensor data and the status pattern will thus be different depending on the status of one or more fuses in the door operator 1**.

According to an aspect, a status alarm event could be triggered by the status management unit 12 in response to that a status pattern associated with that a fuse is broken is determined. According to an aspect, different status alarm events could be triggered depending on the type and location of the broken fuse. According to an aspect, sensor data comprising data of the voltage of the battery during charging and load is sent to the remote entity 50.

According to an aspect, sensor data comprising data of the voltage of the battery during charging and load and the number of active cells can be sent together with the temperature of the battery and other sensor data collected from other sensors 6-1, 6-2, . . . , **6-*m* to the remote entity 50**.

According to an aspect, a voltage sensor 6-1, 6-2, . . . , **6-*m* is arranged to provide sensor data associated with an overvoltage of the battery. Overvoltage can occur if batteries are charged in low temperatures. The battery is not always damaged by overvoltage, but the nominal cell voltage will increase and can cause problem with the operation of the battery. The status management unit 12 receives the sensor data from the voltage sensor 6-1, 6-2, . . . , 6-*m*** and determine a status pattern of the battery having an overvoltage. The determined status pattern is based on the received sensor data and the status pattern will thus be different depending on the amount of overvoltage of the battery.

According to an aspect, the status management unit 12 trigger a status alarm event in response to that a status pattern associated with that the battery has an overvoltage is determined.

The status alarm event could according to some aspects comprise information of a time within which the door operator 1 should have service to avoid breakdown.

According to some aspects, the sensor data from one or more sensors 6-1, 6-2, . . . , **6-*m* from one or more door operators 1 is used to find solutions to problems in certain environments of the door operator 1**.

According to an aspect, one or more of the one or more 6-1, 6-2, . . . , **6-*m* is a sound sensor. The sound sensor 6-1, 6-2, . . . , 6-*m* is arranged to provide sensor data associated with noise associated with the gear box of the door operator 1. According to an aspect the sound sensor 6-1, 6-2, . . . , 6-*m* is a microphone 6-1, 6-2, . . . , 6-*m***.

According to an aspect, the status management unit 12 receives the sensor data from the sound sensor 6-1, 6-2, . . . , **6-*m* and determine one or more status patterns associated with specific identified sounds of the door operator 1 associated with the gear box. According to an aspect, one or more status patterns are associated with specific identified sound patterns of the door operator 1 associated with the gear box. The specific sounds or sound patterns of the gear box could be an indication of that there is something wrong with the gear box. According to an aspect, the status management unit 12 determines a status pattern that is associated with a specific sound or sound pattern of the gear box that associated with some kind of fault in the gear box. According to an aspect, the status management unit 12 triggers a status alarm that is a service alarm event in response to that the status pattern associated with the gear box and that there is something wrong with the gear box is determined. The service alarm event could according to some aspects comprise information of a time within which the door operator 1** should have service to avoid breakdown.

According to an aspect, one or more of the one or more sensors 6-1, 6-2, . . . , **6-*m* is a friction sensor. The friction sensor 6-1, 6-2, . . . , 6-*m* is arranged to provide sensor data associated with the total friction of the operation of the door operator 1 According to an aspect, the friction sensor 6-1, 6-2, . . . , 6-*m* is arranged to provide sensor data associated with the total friction of the operation of the door operator 1 and the door leaf 5. According to an aspect the friction sensor 6-1, 6-2, . . . , 6-*m* is arranged to provide sensor data associated with the friction of the gear box. According to an aspect, the status management unit 12 determines a status pattern of the received sensor data associated with the status of the system and/or the gear box. According to an aspect, the status management unit 12 determines a status pattern associated with the friction of the system and/or the gear box by comparing the received sensor data with sensor data of the average friction of the system and/or the gear box. By comparing sensor data with average sensor data status patterns is determined that is associated with changes in friction. A status pattern could be associated with sensor data that is similar to sensor data of that the friction is similar to the average friction. According to an aspect, the status management unit 12 triggers a status event that is a non-service alarm event when determining the status pattern of that the sensor data is similar to the average sensor data. The non-service alarm is an input of that the sensors 6-1, 6-2, . . . , 6-*m* are working and an indication of that the door operator 1 doesn't need a service for the moment. According to an aspect, the friction sensor 6-1, 6-2, . . . , 6-*m* comprise a current sensor and a voltage sensor 6-1, 6-2, . . . , 6-*m***.

According to an aspect, the service management unit 12 triggers a service alarm event when determining a status pattern associated with sensor data obtained from the friction sensor 6-1, 6-2, . . . , **6-*m* that is associated with an increased or decreased friction in view of the average friction. According to an aspect, the friction sensor 6-1, 6-2, . . . , 6-*m* provide sensor data associated with the total system friction and the status management unit 12 determines a status pattern by comparing it with an average friction to quick detect changes in system friction. According to an aspect, the sensor data associated with the friction of the system and/or gear box is sent to the remote entity 50. The sensor data could be used for predicting how long time a door operator 1** or gear box will last in different environments and to find solutions to problems in certain environments.

According to an aspect, the sensor data associated with the friction of the system and/or gear box is sent together with sensor data associated with the temperature and/or sensor data from the one or more sensors 6-1, 6-2, . . . , **6-*m* of the door operator 1 to the remote entity 50. The sensor data could be used for predicting how long time a door operator 1** or gear box will last in different environments and to find workarounds for problems in certain environments.

According to an aspect, one or more of the one or more sensors 6-1, 6-2, . . . , **6-*m* is at least an encoder speed sensor 6-1, 6-2, . . . , 6-*m*. According to an aspect, one or more of the one or more sensors 6-1, 6-2, . . . , 6-*m* is a motor voltage sensor 6-1, 6-2, . . . , 6-*m*. According to an aspect, one or more of the one or more sensors 6-1, 6-2, . . . , 6-*m* is a motor current sensor 6-1, 6-2, . . . , 6-*m*. The encoder speed sensor 6-1, 6-2, . . . , 6-*m* is arranged to provide sensor data associated with the encoder speed. The motor voltage sensor 6-1, 6-2, . . . , 6-*m* is arranged to provide sensor data associated with the voltage of the motor of the drive unit 2. The motor current sensor 6-1, 6-2, . . . , 6-*m* is arranged to provide sensor data associated with the current of the motor. According to an aspect, the inner resistance of the motor is calculated based on the sensor data from the encoder speed sensor, a motor voltage sensor and motor current sensor 6-1, 6-2, . . . , 6-*m*. According to an aspect, the inner resistance of the motor is calculated based on the sensor data from the encoder speed sensor, a motor voltage sensor and motor current sensor 6-1, 6-2, . . . , 6-*m* when the door operator 1** runs on a constant low speed, (2-20% of nominal motor speed) with relatively high current (1-4 times the nominal motor current) and sensor data associated with the temperature of the motor and sensor data associated with the rated data of the motor.

According to an aspect, status management unit 12 configured to receive the sensor data from the encoder speed sensor, the motor voltage sensor and/or the motor current sensor 6-1, 6-2, . . . , **6-*m*** and to determine a status pattern of the operation of the inner resistance of the motor. The determined status pattern is based on the received sensor data and the status pattern will thus be different depending on the inner resistance of the motor.

According to an aspect, the status management unit 12 trigger a status event that is a service alarm event if a status pattern is determined that is associated with an increased inner resistance of the motor.

If inner resistance increases this is an indication of that the brushes (not disclosed) of the motor is worn out and need to be replaced. The service alarm event is triggered in response to detected status pattern comprising information of that the door operator 1 needs a service within a certain amount of time to reduce the risk of a breakdown of the door operator 1.

According to an aspect, the status management unit 12 is configured to receive sensor data from a voltage sensor, a current sensor, the friction sensor and/or an acceleration sensor 6-1, 6-2, . . . , **6-*m*. According to an aspect, the status management unit 12 receives the sensor data from one or more of the sensor 6-1, 6-2, . . . , 6-*m* to determine a status pattern associated with the efficiency of the motor and/or gearbox of the door operator 1**. If the efficiency is too low, the system will generate too much heat.

According to an aspect, the status management unit 12 triggers a status event that is a status event alarm in response to that a status pattern is determined that is associated with a fault or change in the efficiency. The service alarm event could be associated with a call for service of the door operator 1.

According to an aspect, the sensor data associated with the efficiency is sent to the remote entity 50 for long time predictability to know in advance how long time a door operator 1 will last in different environments and to find workarounds for problems in certain environments.

According to one aspect, one or more of the one or more sensors 6-1, 6-2, . . . , **6-*m* is an encoder speed sensor. The encoder speed sensor 6-1, 6-2, . . . , 6-*m*** is configured to provide status data associated with the encoder speed.

According to an aspect, the status management unit 12 receives the sensor data from the encoder speed sensor 6-1, 6-2, . . . , **6-*m*** and determines a status pattern out of the plurality of status patterns of the operation of the encoder. The determined status pattern is based on the received sensor data and the status pattern will thus be different depending on the status of the encoder (not disclosed).

According to an aspect, the status management unit 12 receives the sensor data from the encoder speed sensor, motor voltage sensor, motor current sensor and/or motor resistance sensor 6-1, 6-2, . . . , **6-*m*** and determines a status pattern of the operation of the encoder. Encoder error can be detected if the encoder speed differs too much from a calculated motor speed based sensor data associated with the motor voltage, the motor current and the motor resistance.

According to an aspect, the status management unit 12 triggers a status event alarm in response to that a status pattern is determined that is associated with an error in the encoder. The service alarm event could be associated with a call for service of the door operator 1.

According to an aspect, the sensor data associated with the encoder and the speed is sent to the remote entity 50 for long time predictability to know in advance how long time a door operator will last in different environments and to find workarounds for problems in certain environments.

According to one aspect, one or more of the one or more sensors 6-1, 6-2, . . . , **6-*m* is a friction sensor. The friction sensor 6-1, 6-2, . . . , 6-*m* is configured to observe and obtain status data associated with the friction of the belt transmission of the door operator. According to an aspect, the friction sensor 6-1, 6-2, . . . , 6-*m* comprise a current sensor and a voltage sensor 6-1, 6-2, . . . , 6-*m***.

According to one aspect, one or more of the one or more sensors 6-1, 6-2, . . . , **6-*m* is an inertia sensor. The inertia sensor 6-1, 6-2, . . . , 6-*m* is configured to observe and obtain status data associated with the inertia of the door leaf 5**.

According to an aspect, status management unit 12 is configured to receive the sensor data from the friction sensor 6-1, 6-2, . . . , **6-*m* and the inertia sensor 6-1, 6-2, . . . , 6-*m* and to determine a status pattern of the operation of a belt of a door operator 1. The determined status pattern is based on the received sensor data and the status pattern will thus be different depending on the status of the belt. A broken belt can be identified if the friction and inertia disappears or are zero from beginning of an opening and/or closing cycle. It can also be detected if there is nothing that stops the rotation of the motor in either the open or closed position of the door leaf 5. This is for instance valid for sliding doors as disclosed in FIG. 3, swing doors as disclosed in FIG. 4, sectional doors, high speed doors as disclosed in FIG. 5** and gates.

According to an aspect, the status management unit 12 triggers a status event alarm in response to that a status pattern is determined that is associated with a broken belt. The service alarm event could be associated with a call for service of the door operator 1.

According to an aspect, one or more of the one or more sensors 6-1, 6-2, . . . , **6-*m* is a sound sensor. The sound sensor 6-1, 6-2, . . . , 6-*m* is arranged to provide sensor data associated with noise associated with the belt of the door operator. According to an aspect the sound sensor 6-1, 6-2, . . . , 6-*m* is a microphone 6-1, 6-2, . . . , 6-*m***.

According to an aspect, the sound sensor 6-1, 6-2, . . . , **6-*m* is arranged to provide sensor data associated with noise associated with the one or more parts of the door operator 1 or the door leaf 5**.

According to an aspect, the status management unit 12 receives the sensor data from the sound sensor 6-1, 6-2, . . . , **6-*m* and determine one or more status patterns associated with specific identified sounds of the door operator 1 associated with a tweaking belt. A tweaking belt can be identified by sound analysis where the status pattern is determined in view of specific characteristics of a tweaking belt that is identified by digital sound processing in a microcontroller. The status management unit 12** can determine different status patterns in view of different characteristics of the provided sensor data.

According to an aspect, the status management unit 12 triggers a status event that is a service alarm event in response to that a status pattern is determined that is associated with a tweaking belt. The service alarm event could be associated with a call for service of the door operator 1.

According to an aspect, the status management unit 12 is configured to receive the sensor data from the inertia sensor 6-1, 6-2, . . . , **6-*m* and to determine a status pattern of the operation of the belt of a door operator 1**.

According to an aspect, the status management unit 12 is configured to receive the sensor data from the inertia sensor 6-1, 6-2, . . . , **6-*m* and to determine a status pattern of the operation of the gear box of the door operator 1**.

According to an aspect, a loose belt or play in the gear box or transmission can be identified by analysis of the sensor data provided by the inertia sensor 6-1, 6-2, . . . , **6-*m*. A loose belt is characterized by a delay of the feedback from the inertia in the door operator 1 when changing speed of the door leaf 5. When changing from negative to positive torque the drive unit 2 will easily increase speed the first couple of milliseconds and then the play in the belt will be caught up and the speed on the encoder will suddenly go down to the speed of the actual door leaf 5** speed. The time delay and difference in speed gives a picture of the play in the transmission and can be used to determine a status pattern and an associated status event that comprise information that there is a need for service.

According to an aspect, the status management unit 12 triggers a status event alarm in response to that a status pattern is determined that is associated with a loose belt or a play in the gear box or the transmission. The service alarm event could be associated with a call for service of the door operator 1.

According to one aspect, one or more of the one or more sensors 6-1, 6-2, . . . , **6-*m* is a friction sensor and a speed sensor 6-1, 6-2, . . . , 6-*m*. The friction sensor and the speed sensor 6-1, 6-2, . . . , 6-*m*** are configured to provide status data associated with the alignment of the carriage wheels.

According to an aspect, status management unit 12 is configured to receive the sensor data from the friction sensor and the speed sensor 6-1, 6-2, . . . , **6-*m*** and to determine a status pattern of the operation of carriage wheels. The determined status pattern is based on the received sensor data and the status pattern will thus be different depending on the status and the alignment of the wheels. Bad alignment will result in high friction and will tear down the ball bearings in the wheels and it will tear down the track as well. This can be identified as high friction and measured at low speed during opening or closing.

According to an aspect, the status management unit 12 triggers a status event alarm in response to that a status pattern is determined that is associated with a badly aligned carriage wheel or a high friction in the carriage. The service alarm event could be associated with a call for service of the door operator 1.

According to an aspect, the status management unit 12 receives sensor data from the sound sensor 6-1, 6-2, . . . , **6-*m* and determine one or more status patterns associated with specific identified sounds of the door operator 1 associated with one or more damaged ball bearings in the door operator 1 or the door leaf. A damaged ball bearing will generate a characteristic sound that can be identified by the sound sensor 6-1, 6-2, . . . , 6-*m*. The status management unit 12** can determine different status patterns in view of different characteristics of the provided sensor data.

According to an aspect, the status management unit 12 triggers a status event alarm in response to that a status pattern is determined that is associated with a tweaking belt. The service alarm event could be associated with a call for service of the door operator 1.

According to an aspect, the status management unit 12 receives sensor data from the sound sensor 6-1, 6-2, . . . , **6-*m* and determine one or more status patterns associated with specific identified sounds of the door operator 1 associated with a damaged surface of one or more wheels. A damaged surface of a wheel will generate a characteristic sound that can be identified by the sound sensor. The status management unit 12** can determine different status patterns in view of different characteristics of the provided sensor data.

According to an aspect, the status management unit 12 triggers a status event alarm in response to that a status pattern is determined that is associated with a damaged surface of a wheel. The service alarm event could be associated with a call for service of the door operator 1.

According to an aspect, the status management unit 12 receives sensor data from the sound sensor 6-1, 6-2, . . . , **6-*m*** and determine one or more status patterns associated with specific identified sounds of the door operator associated with a damaged track that the wheels run upon. A damaged track will generate a characteristic sound that can be identified by the sound sensor. The status management unit can determine different status patterns in view of different characteristics of the provided sensor data.

According to an aspect, the status management unit 12 triggers a status event alarm in response to that a status pattern is determined that is associated with a damaged track. The service alarm event could be associated with a call for service of the door operator 1.

According to an aspect, the status management unit 12 receives sensor data from the sound sensor 6-1, 6-2, . . . , **6-*m* and determine one or more status patterns associated with specific identified sounds of the door operator 1** associated with a damaged slide track of the arm system. A damaged slide track of the arm system will generate a characteristic sound that can be identified by the sound sensor. The status management unit can determine different status patterns in view of different characteristics of the provided sensor data.

According to an aspect, the status management unit 12 triggers a status event that is a service event alarm in response to that a status pattern is determined that is associated with a damaged slide track of the arm system. The service alarm event could be associated with a call for service of the door operator 1.

According to one aspect, one or more of the one or more sensors 6-1, 6-2, . . . , **6-*m* is a closed loop sensor. The closed loop sensor 6-1, 6-2, . . . , 6-*m* is configured to provide status data associated with the control unit 4**.

According to an aspect, status management unit 12 configured to receive the sensor data from the closed loop sensor 6-1, 6-2, . . . , **6-*m*** and to determine a status pattern of the operation of the arm system. The determined status pattern is based on the received sensor data and the status pattern will thus be different depending on the different statuses of the arm system.

According to an aspect, a play in the arm system can be identified by analysis of the closed loop feedback in the control unit. Play in the arm system is characterized by a delay of the feedback from the inertia in the door when changing speed of the door leaf 5. When changing from negative to positive torque the drive unit will easily increase speed the first couple of milliseconds and then the play in the belt will be caught up and the speed on the encoder will suddenly go down to the speed of the actual door leaf 5 speed. The time delay and difference in speed gives a good picture of the play in the transmission and is used by the status management unit to determine the status pattern associated with a play in the arm system.

According to an aspect, a loose fixation between arm and door operator 1 is identified by analysis of the closed loop feedback in the control unit 4. Play in the transmission system is characterized by a delay of the feedback from the inertia in the door operator 1 when changing speed of the door leaf 5. When changing from negative to positive torque the drive unit will easily increase speed the first couple of milliseconds and then the play in the belt will be caught up and the speed on the encoder will suddenly go down to the speed of the actual door leaf speed. The time delay and difference in speed gives a good picture of the play in the transmission and is used by the status management unit to determine the status pattern associated with a loose fixation between the arm and door operator 1.

According to one aspect, one or more of the one or more sensors 6-1, 6-2, . . . , **6-*m* is an inner resistance sensor 6-1, 6-2, . . . , 6-*m*. The inner resistance sensor 6-1, 6-2, . . . , 6-*m* is configured to provide status data associated with the inner resistance of the coil or motor of the drive unit 2**.

According to an aspect, the status management unit 12 is configured to receive the sensor data from the inner resistance sensor 6-1, 6-2, . . . , **6-*m*** and to determine a status pattern of the operation of the coil or motor. The determined status pattern is based on the received sensor data and the status pattern will thus be different depending on the different statuses of the coil and motor.

The inner resistance can change due to temperature, connection resistance and aging of the windings. This can be measured and compared to a limit value where temperature is considered.

If the inner resistance is close to zero or close to infinite the conclusion can be drawn that the lock is out of order and appropriate action can be taken to determine a status pattern that is best for the current situation.

According to an aspect, the status management unit triggers a service event alarm in response to that a status pattern is determined that is associated with a worn coil or motor. The service alarm event could be associated with a call for service of the door operator 1.

According to one aspect, one or more of the one or more sensors 6-1, 6-2, . . . , **6-*m* is a door positioning sensor. The door positioning sensor 6-1, 6-2, . . . , 6-*m* is configured to provide status data associated with the position of the door leaf 5**.

According to an aspect, status management unit 12 configured to receive the sensor data from the door positioning sensor 6-1, 6-2, . . . , **6-*m* and to determine a status pattern of the operation of the door leaf 5 and the door operator 1. The determined status pattern is based on the received sensor data and the status pattern will thus be different depending on the different statuses of the door leaf 5**.

If the status management unit 4 is detecting an obstruction in the same position several times it is reasonable to suspect that there is an object placed in that position or a mechanical problem with the door system that needs to be addressed and a status pattern corresponding to this pattern could be determined.

If someone is trying to open a mechanically locked door with a key impulse, the door leaf will not open and this can be identified by analysing the obstruction in combination with the position of the obstruction and a status pattern corresponding to this pattern could be determined.

If someone is trying to open a mechanically locked door leaf by changing the mode selector of the door operator 1 before unlocking the lock, the door leaf 5 will not open and this can be identified by analysing the obstruction in combination with the position of the obstruction and a status pattern corresponding to this pattern could be determined.

A poorly adjusted or worn lock will prevent the door leaf 5 from closing the last degrees or mm and this can be identified if it happens several times at different occasions. It can be isolated as this problem if the obstruction is always happening at the same position and a status pattern corresponding to this pattern could be determined.

A poorly adjusted or worn lock will prevent the door from opening. This can be identified if it happens several times at different occasions. It can be isolated as this problem if the obstruction is always happening at the same position and a status pattern corresponding to this pattern could be determined.

A poorly adjusted or damaged lock will prevent the door from locking and this can be identified by doing an opening attempt when the door is locked and expect the door to not open due to the lock function. If the door can open the lock has a malfunction and a status pattern corresponding to this pattern could be determined.

According to an aspect, the status management unit 12 triggers a status event alarm in response to that a status pattern is determined that is associated with a malfunction in the door leaf 5 or its lock. The service alarm event could be associated with a call for service of the door operator 1.

According to an aspect, the status management unit 12 receives sensor data from the sound sensor 6-1, 6-2, . . . , **6-*m* and determine one or more status patterns associated with specific identified sounds of the door operator 1 associated with a damaged or worn floor guide. A damaged floor guide will generate a characteristic sound that can be identified by the sound sensor 6-1, 6-2, . . . , 6-*m*. The status management unit 12** can determine different status patterns in view of different characteristics of the provided sensor data.

According to an aspect, the status management unit 12 triggers a status event alarm in response to that a status pattern is determined that is associated with a damaged or worn floor guide. The service alarm event could be associated with a call for service of the door operator.

According to one aspect, one or more of the one or more sensors 6-1, 6-2, . . . , **6-*m* is a friction sensor. The friction sensor 6-1, 6-2, . . . , 6-*m* is configured to observe and obtain status data associated with the friction of the door leaf 5**.

Floor guides with high friction will tear down the floor guides fast. This can be identified as high friction and measured at low speed during opening or closing.

According to an aspect, the status management unit 12 triggers a status event that is a service alarm event in response to that a status pattern is determined that is associated with a damaged or worn floor guide. The service alarm event could be associated with a call for service of the door operator 1.

According to one aspect, one or more of the one or more sensors 6-1, 6-2, . . . , **6-*m* is a presence sensor 8. The presence sensor 8 is configured to observe and obtain status data associated with itself and its function as a presence sensor 8**.

According to an aspect, the status management unit 12 receives sensor data from one or more of the presence sensor 8 and determine one or more status patterns associated with specific identified patterns of the sensor data.

A damaged presence sensor 8 can generate ghost opening impulses, i.e. generate an opening impulse without any person present in the observation field. The status management unit 12 can determine different status patterns in view of different patterns of the provided sensor data.

Ghost impulses can be identified by analysing the sequence impulses pattern of a number of presence sensors 8 in the system. As an example, if an impulse of an inner presence sensor 8 is activated without activating impulse on both inner and outer presence sensors 8, in mentioned order, and not activating the outer impulse it is either a person just passing along with the door or a ghost impulse. The same goes for the outer impulse but in opposite order.

Further, ghost impulses can be identified by analysing the sequence of the other sensor 6-1, 6-2, . . . , **6-*m*** impulses in the system. If a presence impulse is activated when no activation of the other presence impulse and opening impulses are identified there is a possible risk of ghost impulses.

According to an aspect, the status management unit 12 triggers a status event alarm in response to that a status pattern is determined that is associated with a damaged presence sensor 8. The service alarm event could be associated with a call for service of the door operator 1.

According to an aspect, the status management unit 12 receives sensor data from one or more of the presence sensor 8 and determine one or more status patterns associated with the detection field of the presence sensors 8.

Decreased detection fields on the opening impulse field of the presence sensor 8 can be identified by measuring the average time delay between activating the opening impulse and activation of the presence impulse. This will give an indication about how large the opening impulse field are at given time. If this average time is decreasing the field is probably also decreasing.

If the system occasionally indicates presence sensor 8 monitoring failures there is a temporary failure in a presence system.

If the system monitoring of sensors 12 are disabled this indicates that someone has intentionally or unintentionally disabled the monitoring. This can be identified by observing and comparing the monitoring status over time. If a door that initially was configured for monitored sensors are changed it can have been changed unintentionally.

According to an aspect, the status management unit 12 triggers a status event alarm in response to that a status pattern is determined that is associated with a damaged sensor 6-1, 6-2, . . . , **6-*m*, 8. The service alarm event could be associated with a call for service of the door operator 1**.

According to one aspect, one or more of the one or more sensors 6-1, 6-2, . . . , **6-*m* is a vibration sensor. The vibration sensor 6-1, 6-2, 6-*m* is configured to observe and obtain status data associated with vibration of the door operator 1 and/or the door leaf 5**.

According to an aspect, the status management unit 12 receives sensor data from the vibration sensor 6-1, 6-2, . . . , **6-*m* and determine one or more status patterns associated with the vibration in the door operator 1 and/or the doo leaf 5**.

According to an aspect, the status management unit 12 receives sensor data from the vibration sensor 6-1, 6-2, . . . , **6-*m* and the sound sensor and determine one or more status patterns associated with the vibration in the door operator 1 and/or the doo leaf 5**.

If a cover (not disclosed) of the door operator 1 is not firmly attached it can generate vibrations during opening and closing of the door leaf that affects the vibration sensor 6-1, 6-2, . . . , **6-*m*** that is mounted on the vibrating cover. Sound analysis together with opening and presence impulse analysis can generate a conclusion that indicates this specific problem.

If someone is trying to open a locked door leaf 5, small variations in door position can be identified by sensor data from of the encoder position and together with information from the vibration sensors 6-1, 6-2, . . . , **6-*m*** a status pattern can be determined associated with that someone is trying to open the locked door.

According to an aspect, the status management unit 12 triggers a status event that is a burglar alarm in response to that a status pattern is determined that is associated with vibrations in the door operator 1 and/or the door leaf 5. According to an aspect, the service alarm event could be associated with a burglar alarm.

According to an aspect the door operator 1 is a revolving door operator, a swing door operator, a hinged door operator, an up and over door operator, a roll door operator, a garage door operator, an industrial door operator, a gate operator, a barrier operator, or any device having the same function as a door operator.

According to an aspect, the door operator is arranged at a loading dock. One or more of the sensors 6-1, 6-2, . . . , **6-*m* are a sensor arranged at the loading dock. According to an aspect, the supervise unit 4** is connected to a control unit of the loading dock.

The person skilled in the art realizes that the present invention by no means is limited to the preferred embodiments described above. On the contrary, many modifications and variations are possible within the scope of the appended claims. For example, a sliding door set may comprise of more than two sliding door leafs, arranged in the same way as discussed above.

The description of the aspects of the disclosure provided herein has been presented for purposes of illustration. The description is not intended to be exhaustive or to limit aspects of the disclosure to the precise form disclosed, and modifications and variations are possible in light of the above teachings or may be acquired from practice of various alternatives to the provided aspects of the disclosure. The examples discussed herein were chosen and described in order to explain the principles and the nature of various aspects of the disclosure and its practical application to enable one skilled in the art to utilize the aspects of the disclosure in various manners and with various modifications as are suited to the particular use contemplated. The features of the aspects of the disclosure described herein may be combined in all possible combinations of methods, apparatus, modules, systems, and computer program products. It should be appreciated that the aspects of the disclosure presented herein may be practiced in any combination with each other.

It should be noted that the word "comprising" does not necessarily exclude the presence of other elements or steps than those listed. It should further be noted that any reference signs do not limit the scope of the claims.

The invention claimed is:

1. A door operator for moving at least one door leaf between a closed and an open position, the door operator comprising:

a drive unit, a control unit, and an supervise unit, wherein:

the drive unit is adapted to be connected to and move the at least one door leaf between the open and closed position, the control unit is connected to the drive unit and arranged to control a movement of the drive unit;

the supervise unit (4) comprises:

one or more sensors configured to provide sensor data associated with an operation of the door operator or the at least one door leaf;

a status management unit configured to:

receive the sensor data from the one or more sensors;

determine a status pattern of the operation of the door operator or the at least one door leaf out of a plurality of status patterns of the operation of the door operator or the at least one door leaf at least based on the received sensor data, wherein at least a first status pattern out of the plurality of status patterns is associated with a first status event; and trigger the first status event in response to determination of at least the first status pattern.

2. The door operator according to claim 1, wherein the first status event associated with the first status pattern is a service alarm event.

3. The door operator according to claim 1, wherein at least a second status pattern out of the plurality of status patterns is associated with a second status event, wherein the second status event is a non-service event of the door operator, and wherein the status management unit is configured to trigger the non-service event in response to determination of at least the second status pattern.

4. The door operator according to claim 3, wherein at least a third status pattern out of the plurality of status patterns is associated with a third status event, wherein the third status event is a breakdown alarm event of the door operator, and wherein the status management unit is configured to trigger the breakdown alarm event in response to determination of at least the third status pattern.

5. The door operator according to claim 4, wherein the first, second, and third status patterns each is associated with the respective first, second, and third status event.

6. The door operator according to claim 5, wherein the status management unit is configured to trigger the first, second, or third status event in response to determination of the corresponding status pattern.

7. The door operator according to claim 1, wherein at least a fourth status pattern out of the plurality of status patterns is associated with a fourth status event, wherein the fourth status event is an undefinable alarm event of the door operator, and wherein the status management unit is configured to trigger the undefinable alarm event in response to determination of at least the fourth status pattern.

8. The door operator according to claim 1, wherein the plurality of status patterns comprises a plurality of predefined status patterns.

9. The door operator according to claim 1, further comprising a user interface unit connected to the supervise unit and configured to display an alarm based on a service alarm event, breakdown alarm event, or the status event.

10. The door operator according to claim 9, wherein the status management unit is further configured to trigger the service alarm event, breakdown alarm event, status event or a no service event based on at least the determined status pattern.

11. The door operator according to claim 1, wherein the status management unit comprises a data storage configured to store status data associated with the plurality of status patterns, and wherein the status pattern is determined based on a comparison of at least the received sensor data with the sensor data stored in the data storage.

12. The door operator according to claim 11, wherein the data storage is configured to store the plurality of status patterns and status events.

13. The door operator according to claim 1, further comprising a radio communication interface connected to the supervise unit and configured to communicate with at least one remote entity.

14. The door operator according to claim 13, wherein the status management unit is further configured to determine the status pattern of the operation of the door operator or the at least one door leaf out of the plurality of status patterns at least based on a data received by the radio communication interface.

15. The door operator according to claim 13, wherein the radio communication interface is configured to receive a service alarm event from the status management unit and to send a service alarm to the at least one remote entity.

16. The door operator according to claim 13, wherein the status pattern is determined by transmitting from the sensors the sensor data to the at least one remote entity via the radio communication interface, and receiving from the at least one remote entity at least one of: a status pattern out of the plurality of status patterns, a service alarm event, breakdown alarm event, status event or non-service event.

17. The door operator according to claim 13, further comprising: a data storage configured to store sensor data, wherein the status management unit is configured, in response to determination of the status pattern, to save the sensor data associated with the operation of the door operator or the at least one door leaf in the data storage, and wherein the status management unit is further configured to transmit the saved sensor data to the at least one remote entity via the radio communication interface.

18. The door operator according to claim 13, wherein the status management unit is further configured to receive via the radio communication interface from the at least one remote entity at least one status pattern, and store the received at least one status pattern in the data storage.

19. The door operator according to claim 13, wherein at least a fourth status pattern out of the plurality of status patterns is associated with an undetermined status pattern of the operation of the door operator or the at least one door leaf, wherein the status management unit is configured, in response to determination of the fourth status pattern, to send at least the received sensor data via the radio communication interface to at least the remote entity, and receive via the radio communication interface from the at least one remote entity a decision whether the status pattern of the operation of the door operator or the at least one door leaf is of at least the first status pattern or a second status pattern.

20. The door operator according to claim 13, wherein the supervise unit is configured, via the radio communication interface or a user interface, to receive data comprising a confirmation of whether the determined status pattern was correct or not.

21. The door operator according to claim 1, wherein the one or more sensors are at least one of a sound sensor, a movement sensor, a voltage sensor, a current sensor, a resistance sensor, a temperature sensor, a light sensor, a pressure sensor, a humidity sensor, a time sensor, a global positioning system (GPS), an infrared sensor, a camera, a ccd-camera, a time of flight sensor, or an ultrasonic sensor.

22. The door operator according to claim 1, wherein the status management unit is configured to receive data associated with the control unit and presence sensors, and determine the status pattern of the operation of the door operator or the at least one door leaf based on the received data.

23. The door operator according to claim 1, wherein the one or more sensors are configured to provide the sensor data from one or more of a battery, the drive unit, a belt transmission, a carriage wheel, an arm system and a floor guide, sealing's, springs, gear box, guide rails, brakes, shaft, bearings, activation sensors, safety sensors, combined sensors, sensors, light grids, mechanical sensors of the door operator or the at least one door leaf.

24. The door operator according to claim 23, wherein the plurality of status patterns of the operation of the door operator or the at least one door leaf is configured to be updated based on the received data.

25. The door operator according to claim 1, wherein the control unit comprises the supervise unit.

26. The door operator according to claim 1, wherein the control unit and the supervise unit are integrated.

27. The door operator according to claim 1, wherein the door operator is a revolving door operator, a swing door operator, a hinged door operator, an up and over door operator, a roll door operator, a garage door operator, an industrial door operator, a high-speed door operator, a sectional door operator, a gate operator, a barrier operator, or any device having the same function as a door operator.

28. A method in a door operator for moving at least one door leaf between a closed and an open position, the door operator comprising a drive unit, a control unit and an supervise unit, the method comprising:

obtaining sensor data associated with an operation of the door operator or the at least one door leaf from one or more sensors of the supervise unit;

receiving the sensor data from the one or more sensors in a status management unit of the supervise unit;

determining a status pattern of the operation of the door operator or the at least one door leaf out of a plurality of status patterns of the operation of the door operator or the at least one door leaf at least based on the received sensor data, wherein at least a first status pattern out of the plurality of status patterns is associated with a first status event; and triggering the first status event in response to determining at least the first status pattern.

29. The method according to claim 28, wherein the first status event is a service alarm event.

30. The method according to claim 28, wherein at least a second status pattern out of the plurality of status patterns is associated with a second status event, and wherein the second status event is a non-service event of the door operator and further comprising the step of triggering the non-service event in response to determination of at least the second status pattern.

31. The method according to claim 30, wherein at least a third status pattern out of the plurality of status patterns is associated with a third status event, and wherein the third status event is a breakdown alarm event of the door operator and further comprising the step of triggering the breakdown alarm event in response to determination of at least the third status pattern.

32. The method according to claim 31, wherein the first, second, and third status patterns each is associated with the respective first, second, and third status event.

33. The method according to claim 32, further comprising the step of triggering the first, second, or third status event in response to determination of the respective first, second, or third status pattern associated with the first, second, or third status event.

34. The method according to claim 32, further comprising the step of displaying an alarm based on triggering of a service alarm, the breakdown alarm event or the first, second, or third status event.

35. The method according claim 32, further comprising the step of determining a service alarm event, the breakdown alarm event, the first, second, or third status event or a non-service event based on at least the determined status pattern.

36. The method according to claim 28, wherein the step of determining the status pattern further comprising the step of comparing at least the received sensor data with sensor data stored in a data storage of the door operator.

37. The method according to claim 28, wherein the step of determining the status pattern further comprising the step of comparing the sensor data with sensor data received by a radio communication interface.

38. The method according to claim 37, further comprising the step of transmitting from the one or more sensors the received sensor data to at least one remote entity via the radio communication interface, and receiving from the at least one remote entity at least one of: the status pattern out of the plurality of status patterns, a service alarm event, a breakdown alarm event, at least the first status event, or a non-service event.

39. The method according to claim 38, further comprising the step of receiving, via the radio communication interface from the at least one remote entity, at least the first status pattern and storing the received at least the first status pattern in a data storage.

40. The method according to claim 37, further comprising the step of receiving, via the radio communication interface or user interface, data comprising a confirmation of whether the determined status pattern was correct or not.

41. The method according to claim 40, further comprising the step of updating the plurality of status patterns of the operation of the door operator and the at least one door leaf based on the received data.

42. The method according to claim 28, further comprising the step of receiving data from the control unit or presence sensors of the door operator, and wherein the step of determining the status pattern of the operation of the door operator or the at least one door leaf further is based on the received data.

* * * * *